US005884122A

United States Patent [19]

Kawabuchi et al.

[11] Patent Number: 5,884,122

[45] Date of Patent: Mar. 16, 1999

[54] IMAGE FORMING APPARATUS

[75] Inventors: Yoichi Kawabuchi; Eiichiro Kawasaki; Eiichi Yoshida, all of Toyokawa, Japan

[73] Assignee: Minolta Co., Ltd., Osaka, Japan

[21] Appl. No.: 890,007

[22] Filed: Jul. 8, 1997

[30] Foreign Application Priority Data

Jul. 10, 1996 [JP] Japan ..... 8-180490
Jul. 10, 1996 [JP] Japan ..... 8-180502

[51] Int. Cl.[6] ..... G03G 15/00

[52] U.S. Cl. ..... 399/88; 399/43

[58] Field of Search ..... 399/18, 19, 37, 399/38, 43, 75, 77, 82, 83, 87, 88, 90

[56] References Cited

U.S. PATENT DOCUMENTS

| | | | |
|---|---|---|---|
| 4,615,609 | 10/1986 | Honma . | |
| 4,711,556 | 12/1987 | Abuyama | 399/87 |
| 4,870,526 | 9/1989 | Maruta et al. . | |
| 4,882,604 | 11/1989 | Kato et al. | 399/88 |
| 5,670,832 | 9/1997 | Takeda | 399/37 X |

FOREIGN PATENT DOCUMENTS 6-30000 4/1994 Japan .

*Primary Examiner*—Sandra Brase
*Attorney, Agent, or Firm*—Burns, Doane, Swecker & Mathis, LLP

[57] ABSTRACT

An image forming apparatus forming has a resume device to resume a situation when the power supply was turned off. Further, a timer is provided to count a period after the power supply was turned off. A controller inhibits operation of the resume device when the timer counts up a predetermined period. Further, an interrupting device is provided, and when the image forming apparatus is in a predetermined state such as paper empty, the image forming apparatus is operated according to the image forming information entered by the interrupting device. In a different way, an image forming apparatus has a switching device to turn off manually the power supply. After the power supply was turned off with the auto-power-off function, if the power supply is turned on manually, data on image forming saved in a memory are cleared. Thus, a new user can start a copy job readily, while the secrecy of image data of a previous user can be maintained.

21 Claims, 14 Drawing Sheets

IMAGE FORMING APPARATUS

BACKGROUND OF THE INVENTION

1. Field of the Invention

The present invention relates to an image forming apparatus.

2. Description of Prior Art

As a means for solving environmental problems, it is required for electronics equipments and apparatus in offices to decrease energy consumption. In order to decrease energy consumption, for example, auto-shut-off function is provided for turning off the power supply of an apparatus or of a part thereof when the apparatus is not operated for a predetermined time.

In a prior art copying machine having auto-shut-off function for turning off the power supply of the entire apparatus, the power supply is turned off irrespectively of the situation. For example, a trouble such as paper empty or paper jam which inhibits to continue image forming may happen while the user is not present before the copying machine. Even in such a situation, the power supply of the entire apparatus is turned off after a predetermined time passes. In a conventional copying machine, image forming conditions such as paper size, copy number, image density and the like are set before a copy job is started. Therefore, when the power supply of the entire apparatus is turned off, the user who returned before the copying machine has to turn on the power supply and, for example, supply papers in a paper cassette to solve the trouble. Then, the user has to set image forming conditions again before the copy job is restarted. This is inconvenient for the user.

In order to solve this problem, a copying machine may have resume function besides the auto-shut-off function. In the resume function, data on image forming are stored in a backup memory when the power supply is turned off. When the power supply is turned on again, the situation when the power supply is turned off is realized again based on the data stored in the memory. Then, the user can continue image forming soon in the same image forming conditions as those before the power supply is turned off. Then, copying operation can be performed efficiently.

However, the user who operates the copying machine after the power supply has been turned off by the auto-shut-off function is not necessarily the same person. Let us assume, for example, that a trouble such as paper empty happens while the user is not present before the copying machine. If the same user turns on the power supply again, the resume function is effective because the user can restart image forming readily after solving the problem. On the other hand, if a different user turns on the power supply again, the resume function sets image forming conditions which have been set by the previous user. Then, the image forming conditions may be different from the conditions used by the different user. In this case, the different user first resets the image forming conditions and sets new image forming conditions suitable for him or her. Thus, the resume function is inconvenient in this case. Further, in an apparatus where image data as well as image forming conditions are also saved when the power supply is turned off, a different user who turned on the power supply again can output the image dealt by the previous user. This is a problem for secret documents.

SUMMARY OF THE INVENTION

An object of the present invention is to provide an image forming apparatus having resume function which taken the convenience of a user into account.

Another object of the present invention is to provide an image forming apparatus to keep secrecy of data to be copied even if resume function or the like is provided.

In one aspect of the invention, the image forming apparatus forming an image based on image forming condition and image data has a resume device to resume the situation when the power supply was turned off. Further, a timer is provided to count a period after the power supply was turned off. A controller inhibits operation of the resume device when the timer counts up a predetermined period. Thus, when the power supply is turned on again, if the predetermined time has passed after the power supply was turned off, a new copy operation can be started readily because the resume device is not operated. If the memory saves image data, a new user can be prevented to use the saved image data after the predetermined period has passed.

In a second aspect of the invention, an interrupting device is further provided to enter an image forming information into the image forming device. Then, when the image forming apparatus is in a predetermined state such as paper empty, the image forming apparatus is operated according to the image forming information entered by the interrupting device. Then, a user can start a new image forming readily regardless of the state of the image forming apparatus.

In a third aspect of the invention, an image forming apparatus forming an image based on image forming condition and image data has a resume device to resume the situation when the power supply was turned off and a switching device to turn off manually the power supply. After the power supply was turned off with the auto-power-off function, the image forming apparatus is resumed to the state when the power supply was turned off if the power supply is turned on automatically. However, if the power supply is turned on manually with the switching device, data on image forming saved in a memory are cleared. Thus, a new user can start a copy job readily, while the secrecy of image data of a previous user can be maintained.

An advantage of the present invention is that a user can start a new job readily if a predetermined time passes after the power supply of the image forming apparatus was turned off irrespectively of resume function.

Another advantage of the present invention is that a user can start a new job readily if the image forming apparatus cannot continue image forming after the situation when the image forming apparatus was turned off is resumed.

A third advantage of the present invention is that secrecy of image data can be maintained though backup data are saved in a memory.

BRIEF DESCRIPTION OF THE DRAWINGS

These and other objects and features of the present invention will become clear from the following description taken in conjunction with the preferred embodiments thereof with reference to the accompanying drawings, and in which.

DETAILED DESCRIPTION OF THE PREFERRED EMBODIMENTS

Figure 1:
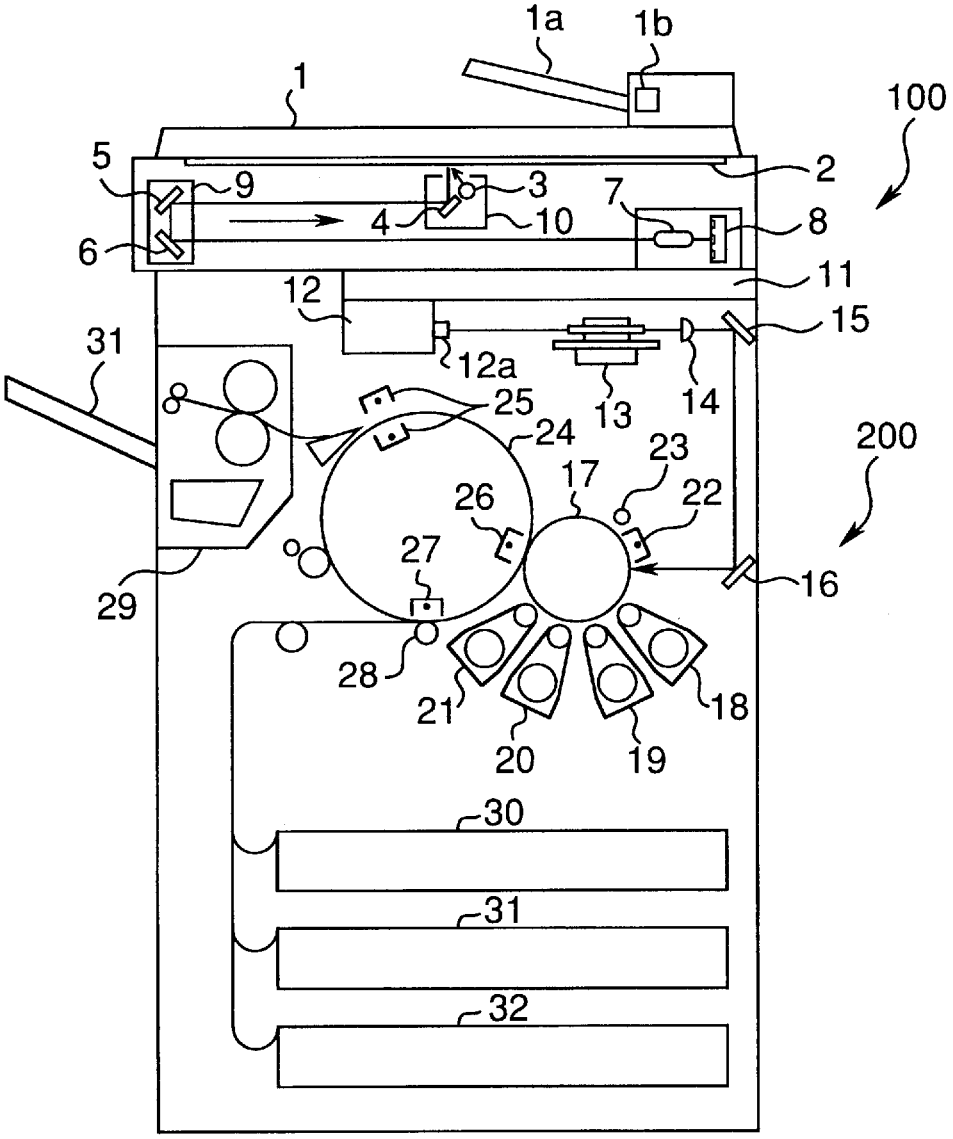
FIG. 1 is a schematic sectional view of a copying machine according to an embodiment of the invention.

Referring now to the drawings, wherein like reference characters designate like or corresponding parts throughout the several views, embodiments of the invention are described.

A. Outline of Image Forming System

FIG. 1 shows a copying machine according to a first embodiment of the invention comprising an image reader 100 for reading image data of a document and a printer 200 for forming an image on a sheet of paper according to the image data read by the image reader 100.

An automatic document feeder 1 provided on the image reader 100 feeds a document from a tray 1*a* onto a platen glass 2 successively. The automatic document feeder 1 may also be used as a document cover, and a document can be put on the platen glass 1 by lifting the feeder 1 manually. The automatic document feeder 1 has a sensor 1*b* for detecting a document put on the platen glass 1 and another sensor (not shown) for detecting the lifting of the automatic document feeder 1.

In the image reader 100, a document on the platen glass 2 is exposed by a lamp 3 in a scanner 10. A light reflected from the document is reflected by mirrors 4, 5 and 6 and is focused by a lens 7 on a full color charge-coupled device (CCD) sensor 8, which converts the reflection light to gradation data of red, green and blue. When a document is scanned, the scanner 10 is moved at a speed V, while the mirrors 5 and 6 mounted in a mirror box 9 is moved at a speed V/2 along a direction shown with an arrow.

In the printer 200, a signal processor 11 receives the gradation data from the CCD sensor 8 and converts them to components of cyan, magenta, yellow and black. The data of each component is sent through an image memory 401 (FIG. 3) to a laser controller 12, which generates signals based on the component for driving a laser diode 12*a*. A photoconductor drum 17 has been exposed by an eraser lamp 23 and has been charged uniformly by a charger 22 before each copying operation. A laser beam emitted by the laser diode 12*a* propagates through a polygon mirror 13, an f-Θ lens 14, mirrors 15 and 16 to scan a photoconductor drum 17 to form an electrostatic latent image. Then, one of developing units 18–21 for cyan, magenta, yellow and black toners is selected to develop the latent image. On the other hand, a sheet of paper is carried from one of paper cassettes 30–32 to be absorbed on a transfer drum 24 by a charger 27 arranged opposite a feeding roller 28. Then, the toner image on the photoconductor drum 17 is transferred onto the sheet of paper by a transfer charger 26. The above-mentioned printing process is repeated for four colors of cyan, magenta, yellow and black. Then, the sheet of paper is separated by a discharger 25 from the transfer drum 24, and the toner image is fixed by a fixing unit 29. Then, it is carried out onto an external tray 31.

Figure 2:
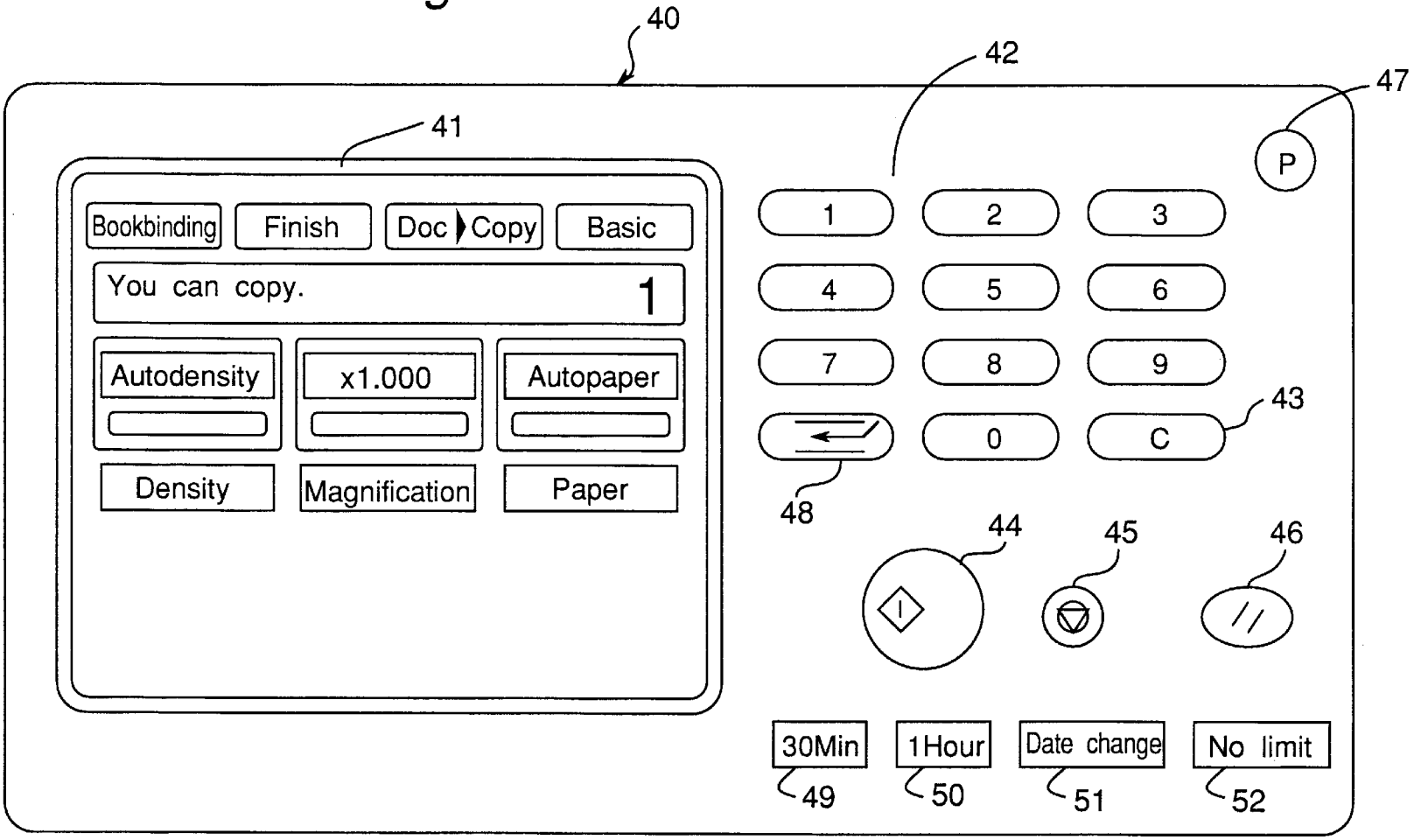
FIG. 2 is a plan view of an operational panel.

FIG. 2 shows an operational panel 40. A liquid crystal touch panel 41 displays image forming conditions such as a number of copies, paper size and the like and the situation of the copying machine, and it displays touch keys for setting each image forming condition. Ten-keys 42 are provided to set the number of copies, the magnification power of copy or the like. A clear key 43 resets the number of copies to one. A start key 44 starts a copying operation, while a stop key 45 stops a copying operation. A panel reset key 46 resets the image forming conditions on print density, magnification power and the like to standard conditions. A power supply key 47 is provided to turn on or off the power supply (FIG. 3) manually. An interrupt key 48 sets or clears interrupt mode for carrying out a new copy job during a copy job.

The copying machine has auto-shut-off function and resume function. In the auto-shut-off function, the power supply of the copying machine is turned off automatically if any key-input is not received for a predetermined time, while in the resume function, the situation of the copying machine when the power supply unit was turned off is resumed when the power supply unit is turned on again. Keys 49–52 are provided to set a control mode on timing condition for the resume function. The key 49 sets a first control mode to cancel the resume function if thirty minutes pass after the power supply unit was turned off, and the key 50 sets a second control mode to cancel the resume function if one hour passes after the power supply unit was turned off. The key 51 sets a third control mode to cancel the resume function if the data is changed. The key 52 sets a fourth control mode to operate the resume function at any time or with no time limit on a time after the power supply unit was turned off. The default control mode is the first control mode.

Figure 3:
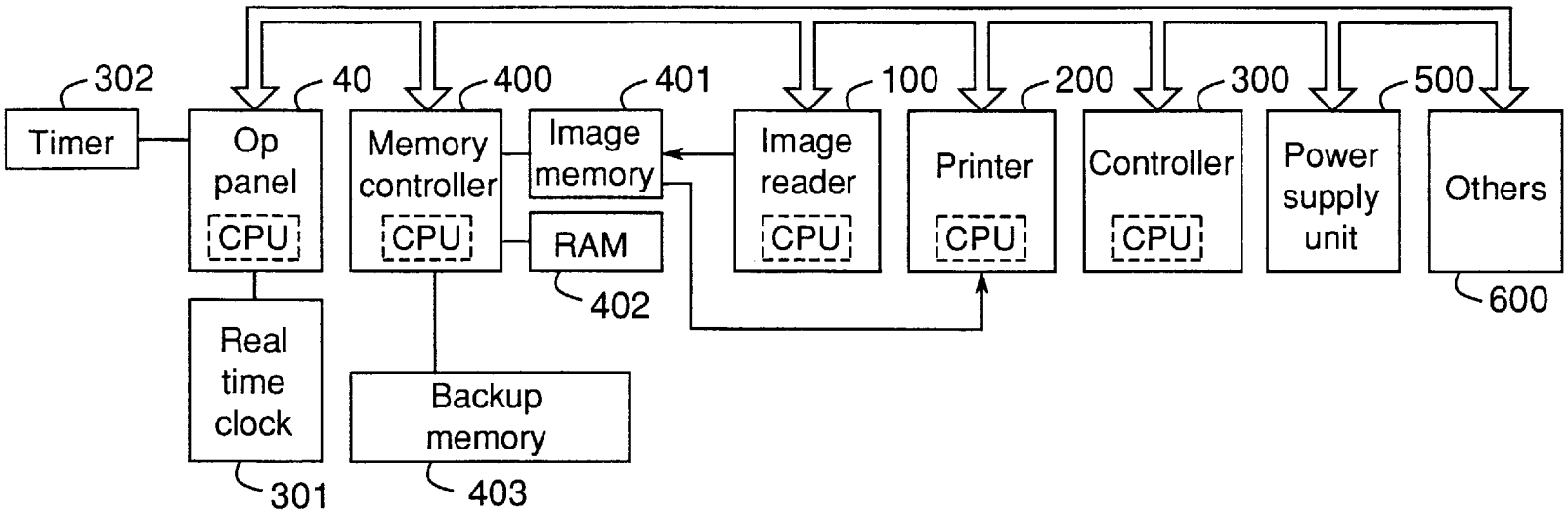
FIG. 3 is a block diagram of a controller of the copying machine.

FIG. 3 is a block diagram of a control system of the copying machine. The control system comprises the operational panel 40, the image reader 100, the printer 200, a controller 300 for controlling the entire system, a memory controller 400, the power supply unit 500, and others 600, and they are connected to each other through a common bus. Each of the operational panel 40, the image reader 100, the printer 200, the general controller 300 and the memory controller 400 has a central processing unit (CPU) which operates independently of each other and communicates data and commands serially through a communication driver (not shown).

The central processing unit in the operational panel 40 controls key-inputs from the operational panel 40 and displays a picture or the like in the touch panel 41. Further, it controls the resume function and the auto-shut-off function and sends a report thereon to the general controller 300. The operational panel 40 is connected to a real time clock 301 and a timer 302. In the control of the resume function, it is decided whether the resume function is operated or not, according as the time of the real time clock 301, when the power supply is turned on, satisfies a timing condition of a current control mode or not, and a report of the decision is sent to the general controller 300. In the control of the auto-shut-off function, it is decided whether the auto-shut-off function is operated or not, according to the count of the timer 302 while the copying machine is remained not to be operated. When the auto-shut-off function is operated, a report is sent to the general controller 300, and the time when the copying machine is shut off, which may also be referred to as "shut down time", is sent to the memory controller 400. These processings will be explained later in detail.

The central processing unit in the general controller 300 initializes the controllers of the operational panel 40, the memory controller 400, the image reader 100 and the printer 200 and controls timings thereof. Further, it sends a control command to the memory controller 400 based on a report sent from the operational panel 40.

The central processing unit in the memory controller 400 controls an image memory 401, a random access memory (RAM) 402, and a nonvolatile memory 403 for backup according to a control command sent from the general controller 300. The image memory 401 stores image data read by the image reader 100. The RAM 402 stores image forming conditions such as control mode, copy number, paper size and the like set with the operational panel 40, and data on the status of the copying machine. When the power supply is turned off by operating the auto-shut-off function, the nonvolatile memory 403 saves image data written to the image memory 401, image forming data and status data written to the RAM 402 and data on shut-down time or auto-shut-off time received through the operational panel 40 from the real time clock 301. The data stored in the image memory 401 and the RAM 402 are called as "data on image forming". Thus, the nonvolatile memory 403 saves data on image forming and data on shut down time. The nonvolatile memory 403 is also used as a backup memory for saving data on image forming when an interrupt is started. When the interrupt mode is cleared, the situation of the copying machine when the interrupt was started is reproduced based on the data saved in the nonvolatile memory 403.

The power supply unit 500 turns off the power supply of the copying machine when power-off command is received from the general controller 300.

B. Control of the Copying Machine

An outline of the control of the copying machine is explained first. The copying machine has three control modes for improving convenience of a user on the auto-shut-off function and the resume function. In the first control mode, if the power supply is turned on again by a user before thirty minutes pass after the power supply was turned off, the situation of the copying machine when the power supply was turned off is reproduced with the resume function. This is based on an assumption that when a user finds that the power supply was turned off during a copy job, he or she will turn on the power supply readily if he or she wants to continue the copy job. However, if the power supply is not turned on until thirty minutes have passed, it is decided that he or she does not want to continue the copy job. Thus, the resume function is not operated so that a new user can start a new copy job easily. Then, each copy mode is initialized, and a new copy job is waited. At the initialization, the image data used by the previous user is cleared. Thus, it is prevented that the new user gets a copy of the image used against the will of the previous user. The thirty minutes adopted in the first control mode means a time criterion for deciding whether the user does not want to continue the copy job.

In the second control mode, one hour is adopted instead of the thirty minutes in the first control mode. If the power supply is turned on again by a user before one hour passes after the power supply was turned off, the resume function is not operated. In the third control mode, date change is adopted instead of the thirty minutes. If the power supply is turned on again by a user before the date is changed after the power supply was turned off, the resume function is not operated. Further, a criterion such as business hour, turning from mourning to afternoon or transition of week may also be used as a predetermined time for clearing backup data so as not to operate the resume function.

Further, when the power supply is turned on again with use of the predetermined time in each mode, the copy job may not be continued again in the resumed situation of the copying machine due to paper empty or the like. If the copy job cannot be continued again, interrupt mode is set automatically so that a different copy job can be started. In this case, a different user can start a new copy job readily when the power supply is turned on again. The interrupt mode is cleared by pressing the interrupt key 48. When the interrupt mode is cleared, the copying machine is returned to the situation reproduced with the resume function. Thus, the user who returns before the copying machine can start the interrupted copy job soon by solving the trouble such as paper empty.

Figure 4:
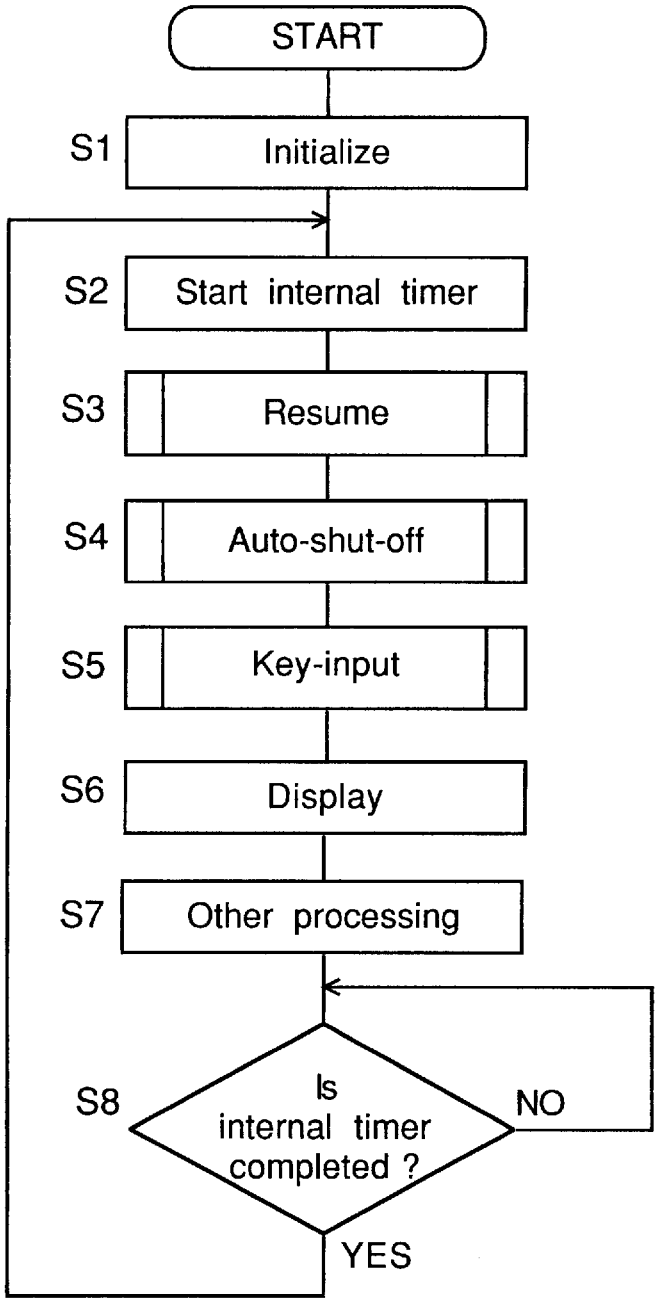
FIG. 4 is a flowchart of an operational panel.

FIG. 4 is a flowchart of the control performed by the central processing unit provided in the operational panel 40. After the initialization (step S1), an internal timer for determining a time length of one routine of this flow is started (step S2). Next, the resume function is controlled based on the time of the real time clock 301 connected to the operational panel 40 (step S3, refer to FIG. 5). Next, the auto-shut-off function is controlled based on the time of the timer 302 connected to the operational panel 40 (step S4, refer to FIG. 6). Next, a key-input from the operational panel 40 is processed (step S5, refer to FIG. 7). In the key-input control, if one of the keys 49–52 is received, one of the first to fourth control modes in correspondence to the key-input is set, and the control mode and the like are displayed in the liquid crystal touch panel 41 (step S6). Then, other control processings are performed (step S7). Next, after the internal timer is completed or the internal time is counted up (YES at step S8), the flow returns to step S2.

Figure 5:
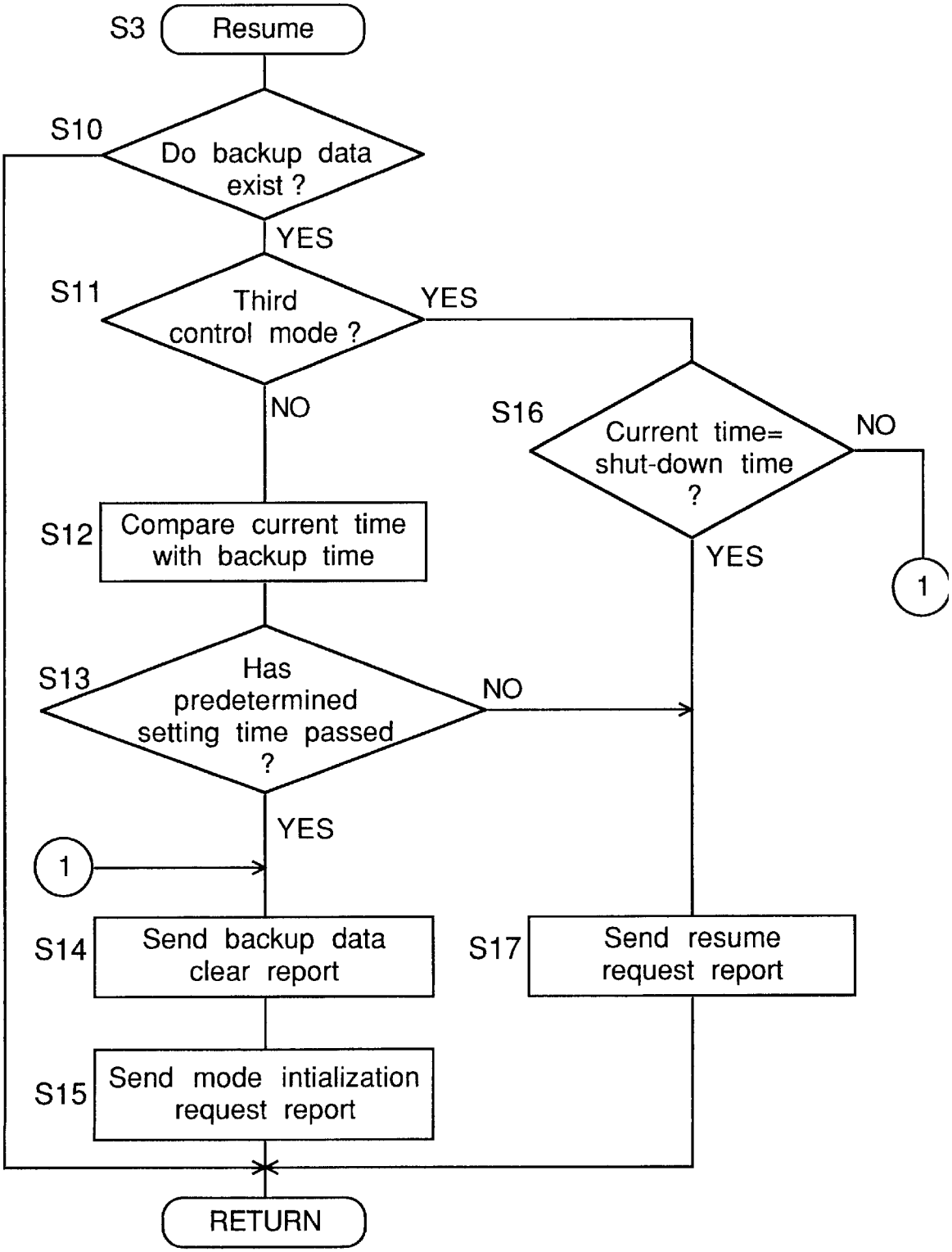
Fig. 5 is a flowchart of resume function.

FIG. 5 is a flowchart of the resume function control (step S3 in FIG. 4). If it is decided that the data on image forming and the time of shut-down are written to the nonvolatile memory 403 as backup data (YES at step S10) or that the power supply was turned off with the auto-shut-off function, the current control mode set by the operational panel 40 is checked first. If there is no backup data in the nonvolatile memory 403, the flow returns readily to the main routine.

Next, if the third control mode is decided to be set (YES at step S1), when the time of the real time clock 301 is the same as that of shut-down saved in the nonvolatile memory 403 (YES at step S16), a resume request report is sent to the general controller 300 to operate the resume function (step S17).

On the other hand, if the time of the real time clock 301 is different from that of shut-down saved in the nonvolatile memory 403 (NO at step S16), a backup data clear request report is sent to the general controller 300 to inhibit to operate the resume function when the power supply is turned on again (step S14). Then, a mode initialization request report is sent to the general controller 300 to initialize the controllers (step S15).

If a control mode other than the third control mode is decided to be set (NO at step S11), the time of the real time clock 301 is compared with that of shut-down saved in the nonvolatile memory 403 (step S12). If the time elapsing after the shut-down time is decided to be shorter than the predetermined time set in the control mode (NO at step S13), a resume request report is sent to the general controller 300 (step S14). On the other hand, if the time elapsing after shut-down time is decided to pass the predetermined time for clearing or deleting backup data set in the control mode (YES at step S13), a backup data clear request report is sent to the general controller 300 to inhibit resume function when the power supply is turned on again (step S14). The above-mentioned predetermined time is thirty minutes in the first control mode, one hour in the second control mode, and date change in the third mode, but it is not provided or no time limit is given in the fourth control mode. Then, in order to permit to start a new copy job, a mode initialization request report is sent to the general controller 300 to request initialization of each of the controllers (step S15).

When the power supply of the copying machine is turned off by pressing the power supply switch 47, no data is written to the nonvolatile memory 403. Further, when the power supply of the copying machine was turned off by the auto-shut-off function but the predetermined time has passed, the data written to the nonvolatile memory 403 are cleared or deleted. In such a case where no data are saved in the nonvolatile memory 403 (NO at step S10), the resume function is not operated or it is inhibited, and the flow returns to the main flow.

Figure 6:
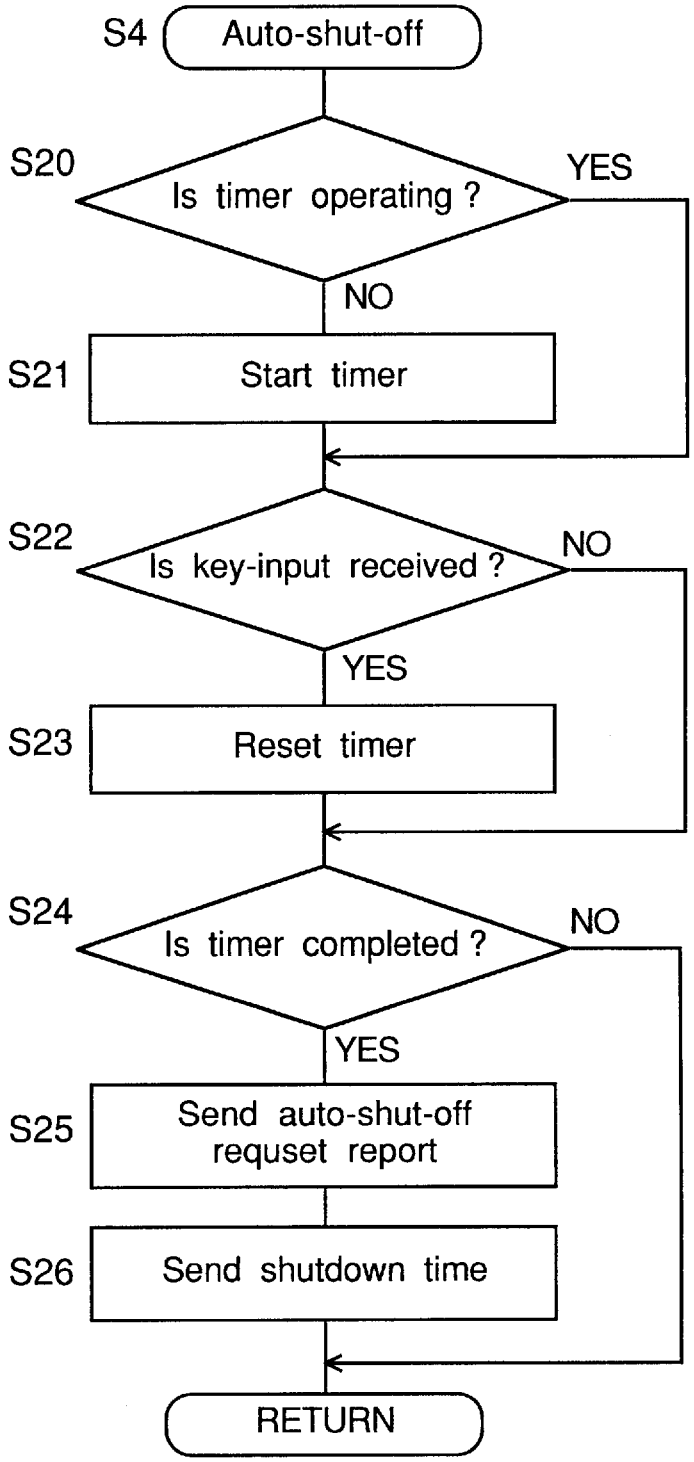
Fig. 6 is a flowchart of auto-shut-off control.

FIG. 6 is a flowchart of the auto-shut-off function control (step S4 in FIG. 4). First, the operation of the timer 302 is controlled. If the timer 302 is decided not to be operating (NO at step S20), the timer 302 is started (step S21). When any key in the operational panel 40 is operated while the timer 302 is operated (YES at step S22), the timer 302 is reset (step S23).

While the timer 302 is operated, if it is decided with the timer 302 that the predetermined time has passed (YES at step S24), an auto-shut-off request report is sent to the general controller 300 (step S25), and data on shutdown time or auto-shut-off time is sent to the memory controller 400 (step S26). If it is decided that the timer 302 has not yet counted up the predetermined time (NO st step S24), the flow returns to the main flow.

Figure 7:
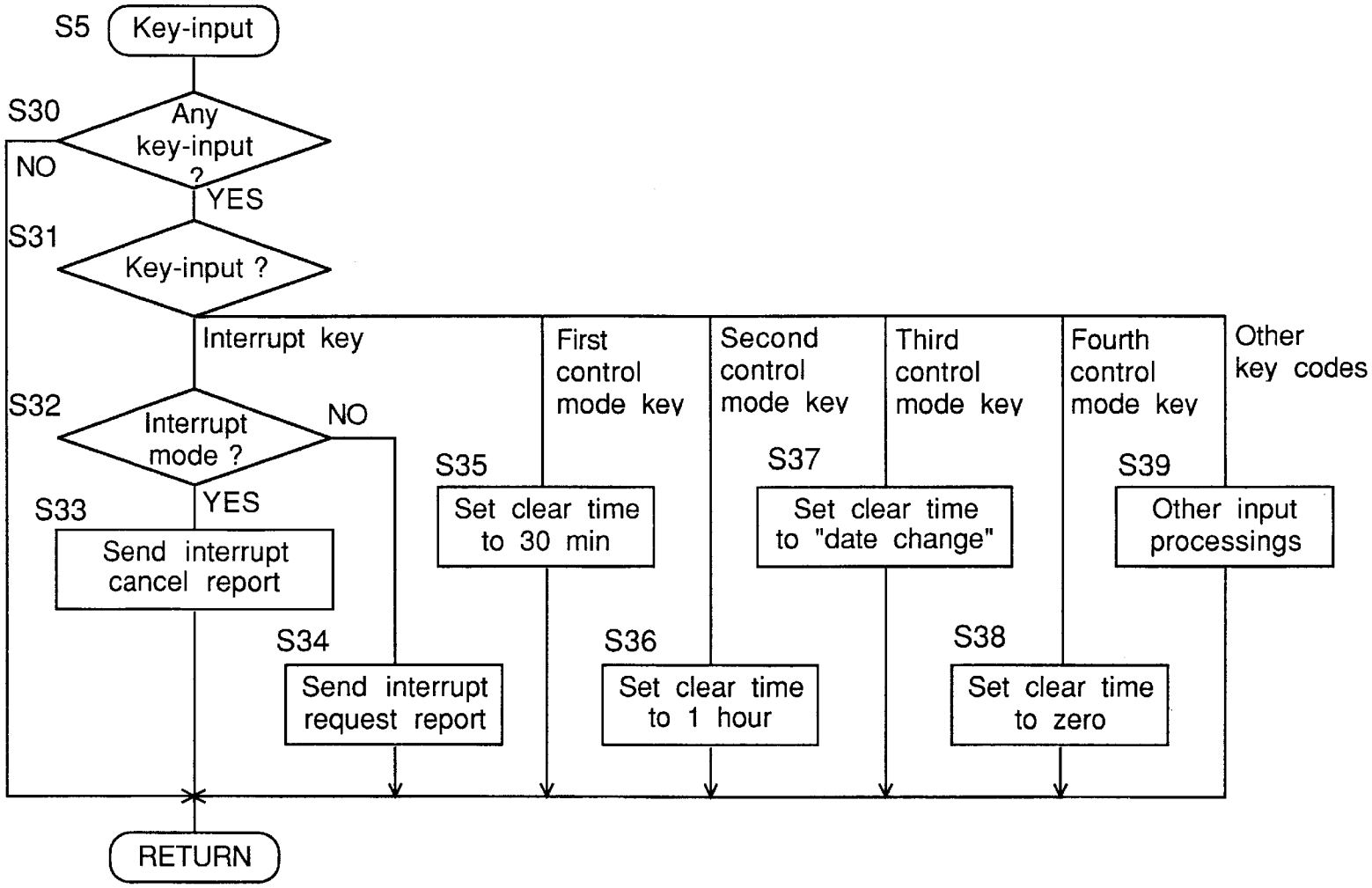
FIG. 7 is a flowchart of input control.

FIG. 7 is a flowchart of the key-input control (step S5 in FIG. 4). When any key in the operational panel 40 is decided to be pressed (YES at step S30), the flow branches according to the type of the key-input (step S31). When the key is the interrupt key 48, if the interrupt mode is set already (YES at step S32), the interrupt mode is canceled, and an interrupt cancel report for canceling the interrupt mode is sent to the general controller 300 (step S33). On the other hand, if the interrupt mode is not set (NO at step S32), the interrupt mode is set, and an interrupt request report for setting the interrupt mode is sent to the general controller 300 (step S34). When the pressed key is the key 49 for setting the first control mode, the first control mode is set to prevent to operate the resume function if a state where the power supply was turned off continues for a time longer than thirty minutes (step S35). When the key is the key 50 for setting the second control mode, the second control mode is set to prevent to operate the resume function if a state where the power supply is turned off continues for a time longer than one hour (step S36). When the pressed key is the key 51 for setting the third control mode, the third control mode is set to prevent the resume function if a state where the power supply is turned off continues until the date changes (step S37). When the pressed key is the key 52 for setting the fourth control mode, the fourth control mode is set to operate the resume function irrespectively of the time after the power supply was turned off (step S38). If the pressed key is different from the above-mentioned keys, a processing in correspondence to the pressed key is performed (step S39). Then, the flow returns to the main flow.

Figure 8:
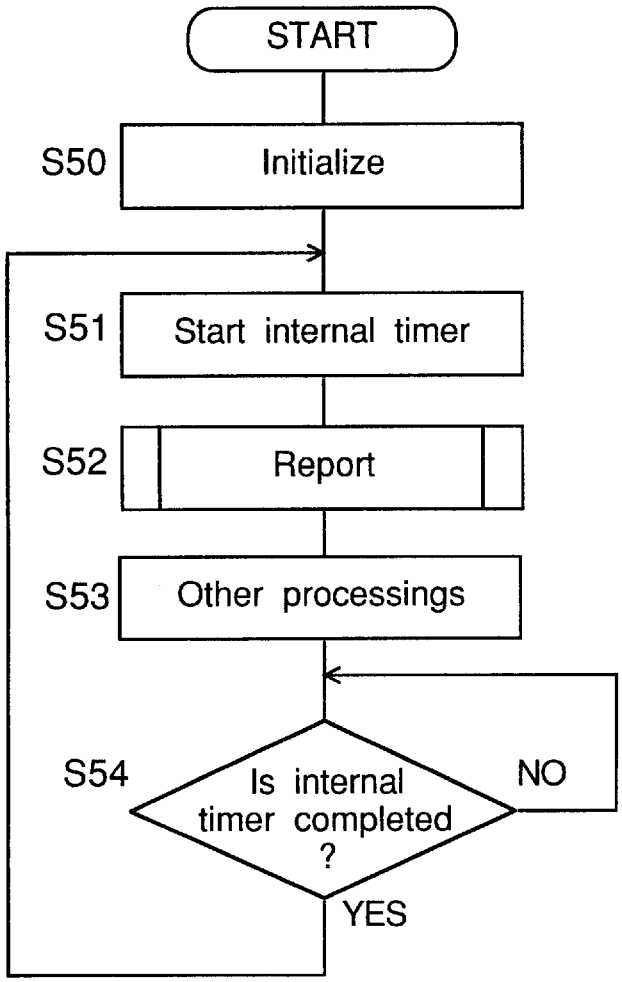
FIG. 8 is a flowchart of a general controller.

Next, a flow of the control of the general controller 300 is explained. The general controller 300 controls the entire system of the copying machine. The general controller 300 sends control commands to other controllers including the memory controller 400 and the power supply unit 500 according to a report sent from the operational panel 40. FIG. 8 is a flow performed by the general controller 300. After the initialization (step S50), an internal timer for determining a time length of one routine of this flow is started (step S51). Next, report processing is performed by analyzing a received report to send a command and to set a mode in correspondence to the report (step S52, refer to FIG. 9). Then, other control processings are performed (step S53), and after the internal timer is completed (YES at step S54), the flow returns to step S51.

Figure 9:
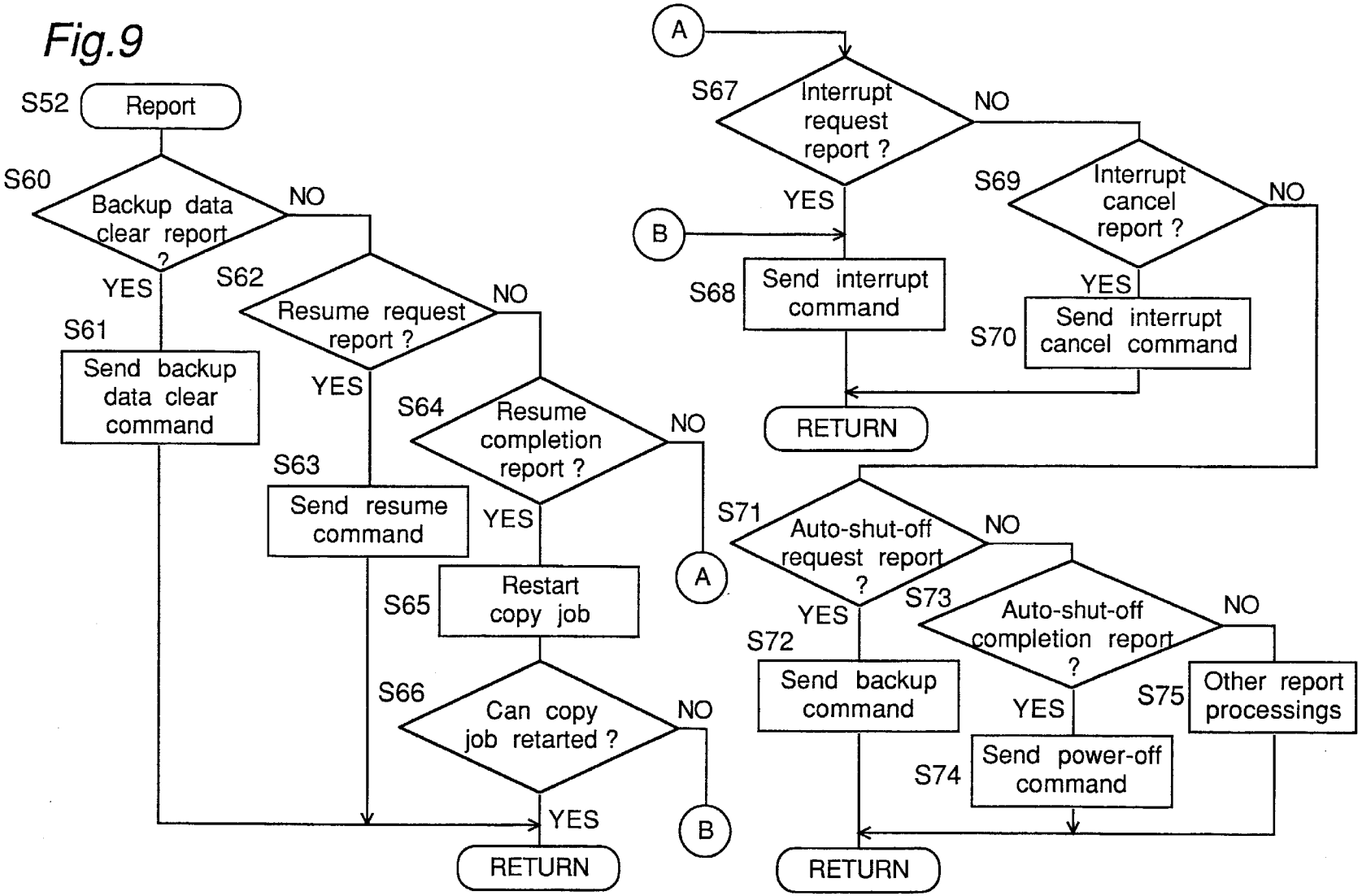
FIG. 9 is a flowchart of report processing.

FIG. 9 is a flowchart of the report processing (step S5 in FIG. 8). If the received report is decided to be a backup data clear report received from the operational panel 40 (YES at step S60), a backup data clear command is sent to the memory controller 400 to clear or delete the data written to the nonvolatile memory 403 (step S61).

If the received report is decided to be a resume request report (YES at step S62), a resume command is sent to the memory controller 400 to operate the resume function in order to resume the situation when the power supply was turned off (step S63).

If the received report is decided to be a resume completion report (YES at step S64), the copy job is restarted (step S65). In this case, if it is decided that the copy job cannot be started for example due to paper empty in the selected paper cassette (NO at step S66), an interrupt command is sent to set interrupt mode so as to permit a new copy job (step S68). In other words, if the copy job cannot be continued out readily when the power supply is turned on again with the resume function, a new copy job can be started for the convenience of users.

If the received report is decided to be an interrupt request report (YES at step S67), an interrupt command is sent to the memory controller 400 (step S68). If the received report is decided to be an interrupt cancel report (YES at step S69), an interrupt cancel command is sent to the memory controller 400 (step S70).

If the received report is decided to be an auto-shut-off request report (YES at step S71), a backup command is sent to the memory controller 400 (step S72). If the received report is decided to be an auto-shut-off completion report (YES at step S73), a power-off command is sent to the power supply unit 500 to request to turn off the power supply of the copying machine (step S74).

A report other than the above-mentioned ones is decided to be received (NO at step S73), a processing in correspondence to the report is performed (step S75).

Figure 10:
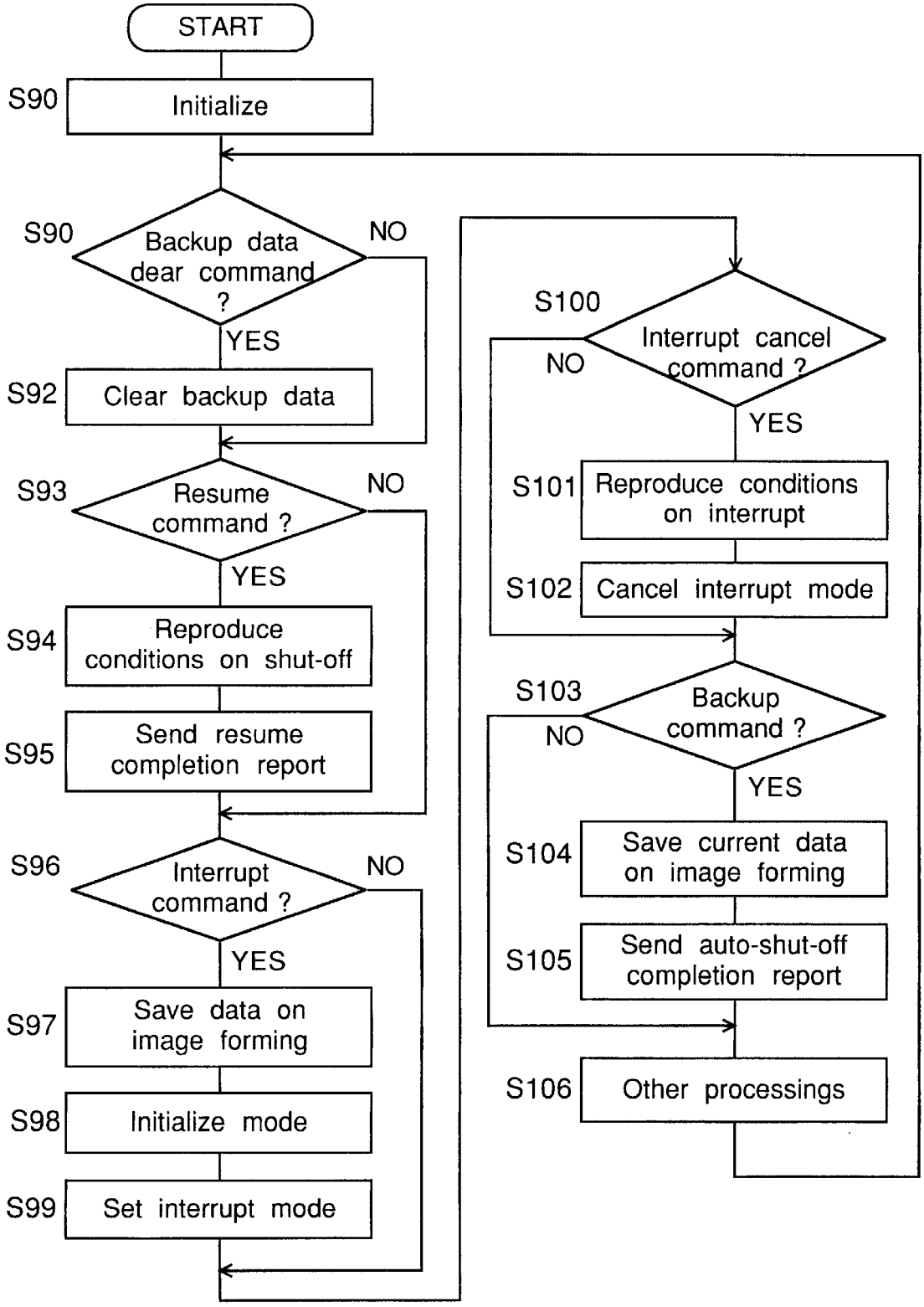
FIG. 10 is a flowchart of a memory controller.

Next, FIG. 10 is a flowchart of the memory controller 400. The memory controller 400 controls the image memory 401, the RAM 402 and the nonvolatile memory 403. After the initialization (step S90), a command sent from the general controller 300 is checked.

If the received command is decided to be a backup data clear command (YES at step S91), the data saved in the nonvolatile memory 403 for backup is cleared (step S92).

If the received command is decided to be a resume command (YES at step S93), the image data among the data on image forming saved in the nonvolatile memory 403 is written to the image memory 401 and the image forming conditions among the data on image forming saved in the nonvolatile memory 403 are written to the RAM 402 in order to reproduce the situation when the power supply was turned off (step S94). After the data write to the memories is completed, a resume completion report is sent to the general controller 300 (step S95).

If the received command is decided to be an interrupt command (YES at step S96), the data on image forming when the interrupt is set, that is, the image data written to the image memory 401 and the image forming conditions written to the RAM 402 are saved in the nonvolatile memory 403 for backup (step S97). Then, the data in the memories 401 and 402 are cleared to initialize the copy mode (step S98), and an interrupt mode is set (step S99).

If the received command is decided to be an interrupt cancel command (YES at step S100), the data on image forming saved in the nonvolatile memory 403 are read to write the image data to the image memory 401 and to write the data on image forming conditions to the RAM 402 (step S101). Thus, the situation when the power supply was turned off is reproduced. Then, the interrupt mode is canceled (step S102).

If the received command is decided to be a backup command (YES at step S103), the data on image forming, that is, the image data written to the image memory 401 and the image forming conditions written to the RAM 402 are saved in the nonvolatile memory 403 for backup (step S104). After the data are saved, an auto-shut-off completion report is sent to the general controller 300 (step S105).

If a command other than the above-mentioned ones is received, a processing in correspondence to the command is performed (step S106), and the flow returns to step S91. For example, the controllers are initialized according to a mode initialization command for a new copy job.

C. Second Embodiment

Next, another copying machine according to a second embodiment of the invention is explained. Similarly to the copying machine of the first embodiment, the copying machine of the second embodiment has the auto-shut-off function to turn off the power supply automatically when the copying machine is not operated for a predetermined time, and the resume function to reproduce the situation when the power supply was turned off when the power supply is turned on again. In this embodiment, when the power supply is turned off manually by pressing a power supply key 47 in the operational panel 40, the resume function is not operated to clear data on image forming. Thus, it is prevented that an image prepared by a previous user is copied illegally.

The copying machine also comprises an image reader 100 for reading image data of a document put on a platen glass and a printer 200 for forming an image on a sheet of paper according to the image data read by the image reader 100, similarly to the counterparts of the first embodiment. Further, the copying machine also comprises an operational panel 40, a power supply unit 500 and others 600 similarly to the counterparts of the first embodiment.

Figure 11:
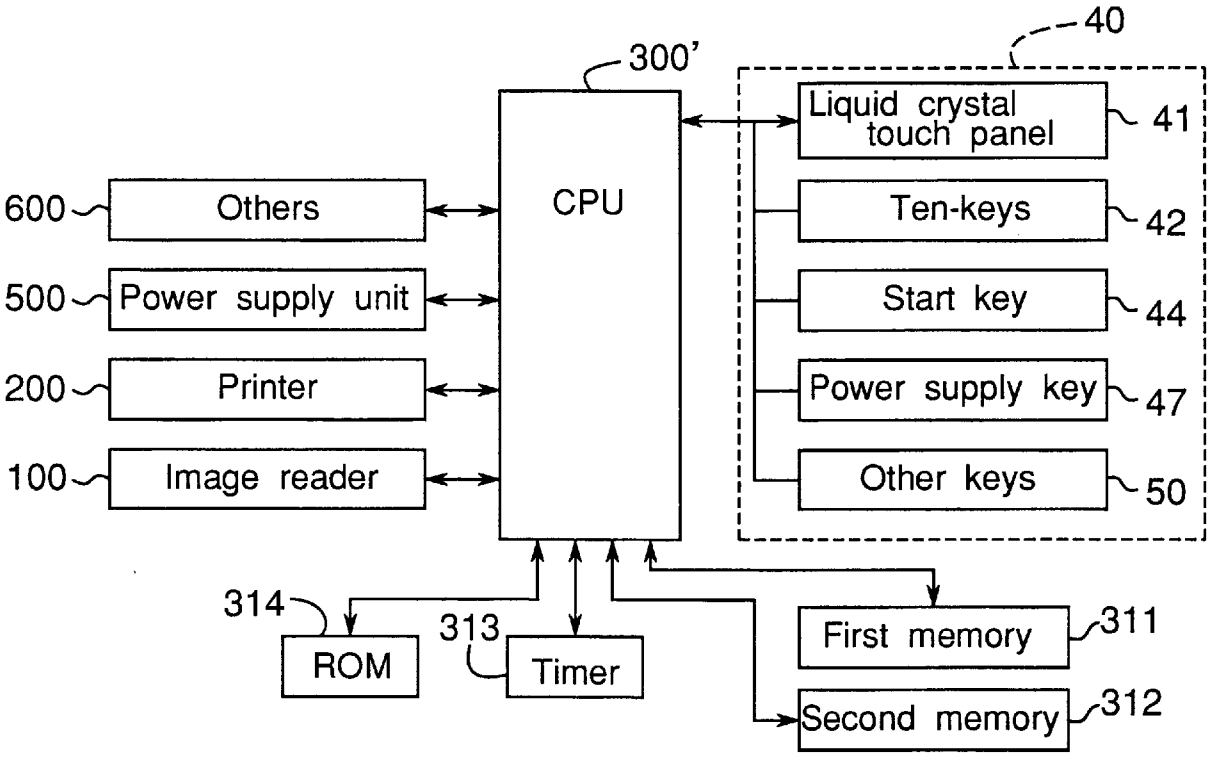
FIG. 11 is a block diagram of a control system of a copying machine of a second embodiment of the invention.

FIG. 11 shows a block diagram of a control system of the copying machine. The control system comprises a general controller 300' for controlling the entire system, and other components connected thereto including the operational panel 40, a first memory 311, a second memory 312 for backup, a timer 313, a ROM 314, the image reader 100, the printer 200, the power supply unit 500, and the others 600. Each of the operational panel 40, the image reader 100 and the printer 200 has a central processing unit (CPU) which operates independently of each other and communicates data and commands serially through a communication driver (not shown) to the general controller 300'. The first memory 311 stores data on image forming conditions set with the operational panel 40 and image data of a document read by the image reader 100. These data are called as data on image forming. The image data stored in the first memory 311 is read if necessary to be sent to the printer 200. When the power supply unit 500 turns off the power supply of the copying machine with the auto-shut-off function, data on image forming stored in the first memory 311 are saved in the second memory 312 for backup. If the power supply key 47 is pressed, the data on image forming stored in the first memory are cleared, and the power supply unit 500 turns off the power supply after completion of the end processing of the controllers.

Figure 12:
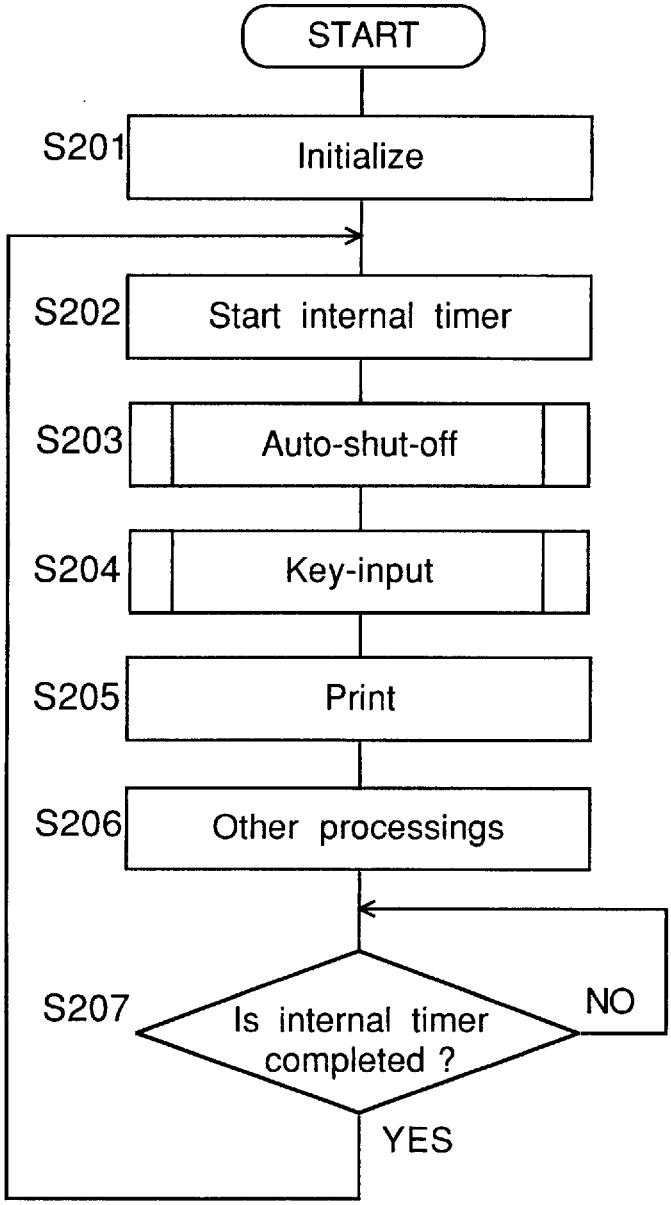
FIG. 12 is a flowchart of a general controller.

Next, the control of the general controller 300' is explained. The general controller 300' controls the entire system of the copying machine. The general controller 300' sends control commands to other controllers including the memory controller 400 and the power supply unit 500 according to a report sent from the operational panel 40. FIG. 12 is a control flow performed by the general controller 300'. After the initialization (step S201), an internal timer for determining a time length of one routine of this flow is started (step S202). Next, auto-shut-off processing is performed if the copying machine is remained not operated for a predetermined time (step S203, refer to FIG. 13), and a key-input in the operational panel is controlled (step S204). Then, printing is performed based on copy conditions (step S205). Next, other control processings are performed (step S206), and after the internal timer is completed (YES at step S207), the flow returns to step S202.

Figure 13:
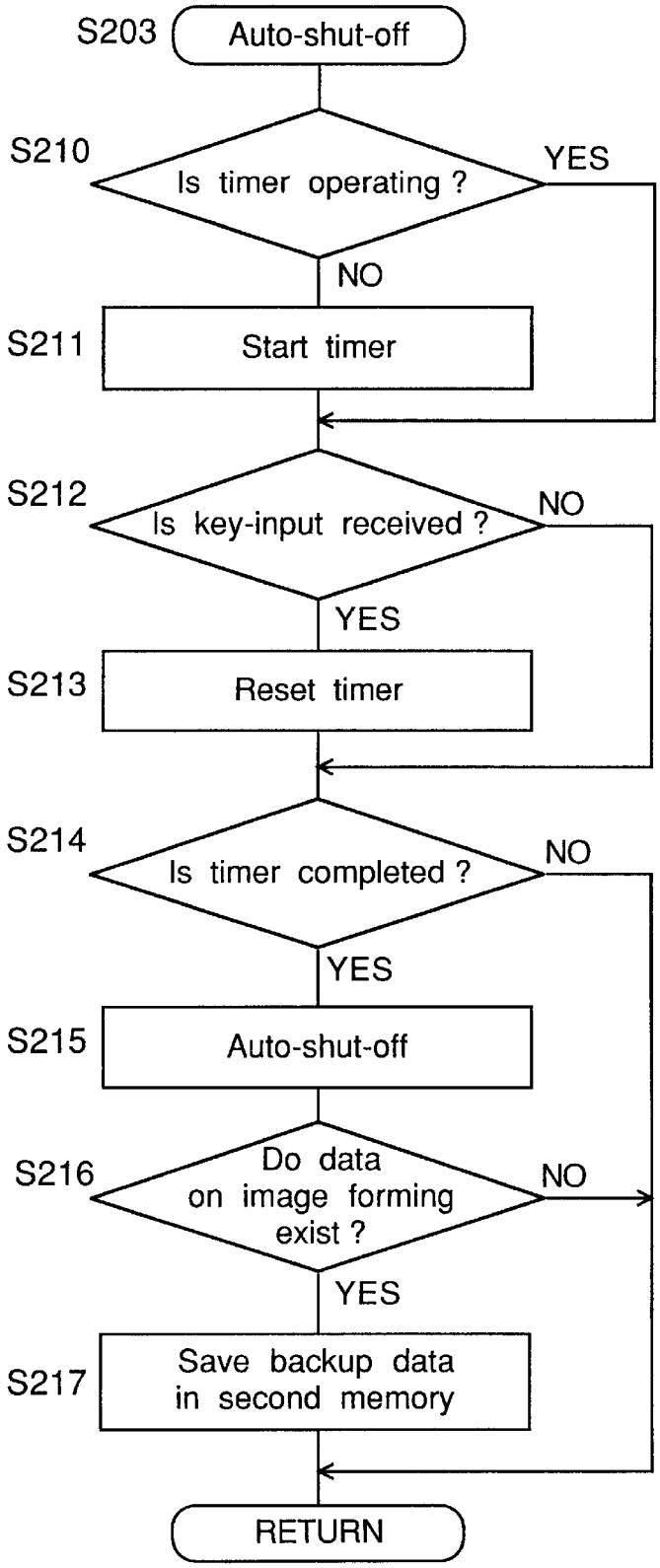
FIG. 13 is a flowchart of auto-shut-off control.

FIG. 13 is a flowchart of the auto-shut-off control (step S202 in FIG. 12). If the timer 312 is decided not to be operating (NO at step S210), the timer 312 is started (step S211). When any key in the operational panel 40 is decided to be received while the timer 312 is operated (YES at step S212), the timer 312 is reset (step S213). While the timer 312 is operated, if it is decided with the timer 312 that the predetermined time has passed (YES at step S214), an auto-shut-off request report is sent to the general controller 300' to turn off the power supply (step S215). If data on image forming exist in the first memory 311 (YES at stp S216), the data are saved in the second memory 212 (step S217). The data includes image forming conditions such as copy number and paper size set with the touch panel 41 and image data of a document read with the image reader 100. On the other hand, the flow returns to the main flow without saving the data if no data on image forming exist in the first memory 311 (NO at. stp S216). The above-mentioned steps S214–S215 may be performed after steps S216–S217 for backup.

Figure 14:
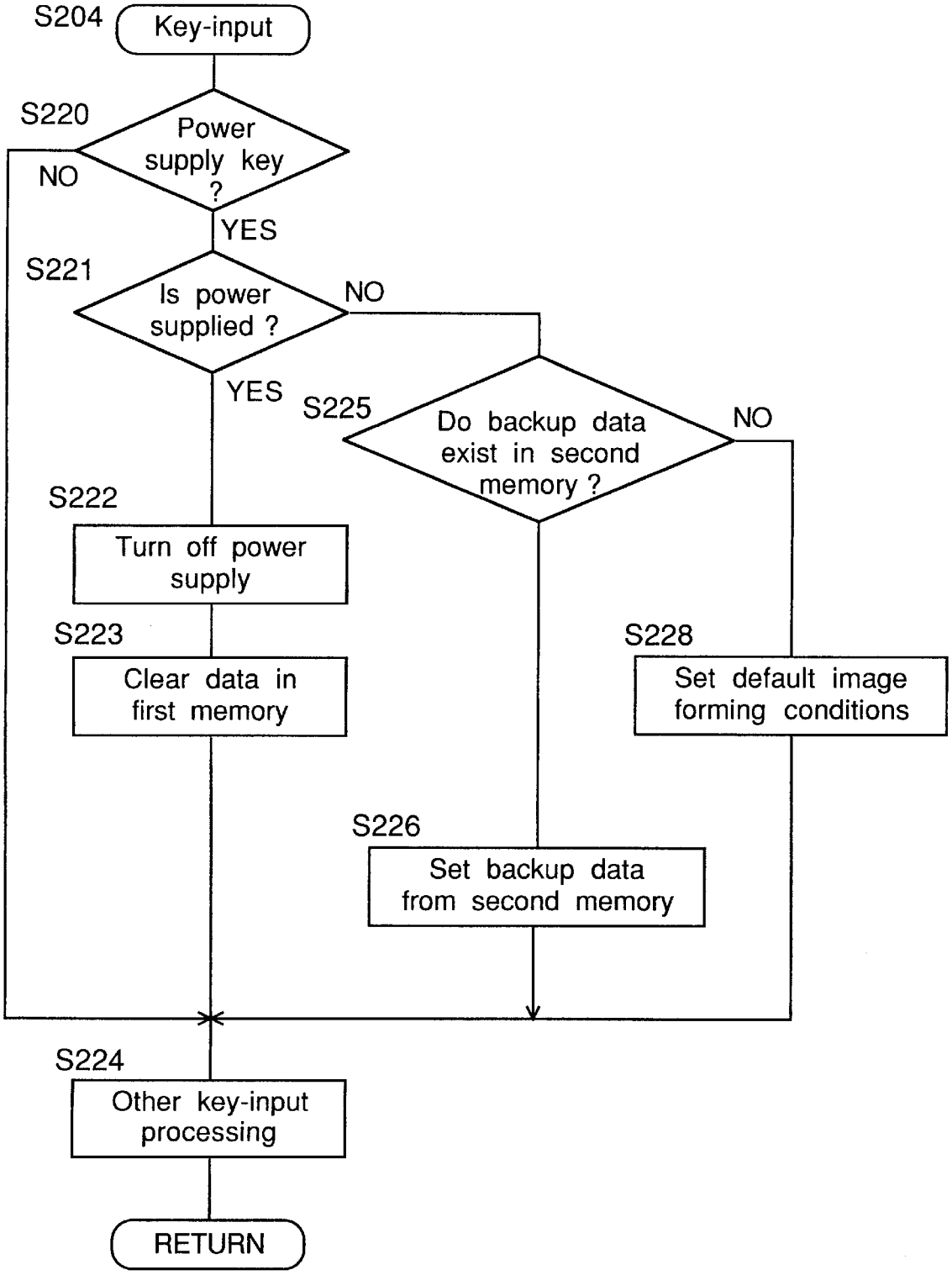
FIG. 14 is a flowchart of input control.

FIG. 14 is a flowchart of the key-input control (step S204 in FIG. 12). The flow branches according to the type of the key-input. If the power supply key 47 in the operational panel 40 is decided to be pressed (YES at step S220), if the power supply unit 500 is supplying electric power (YES at step S221), the power supply is turned off (step S222), and the data on image forming in the first memory 311 are cleared (step S223). On the other hand, if the power supply unit 500 does not supply electric power (NO at step S221), it is decided next if backup data when the power supply was turned off exist in the second memory 312 (step S225). If the backup data are decided to exist in the second memory 312 (YES at step S225), the backup data are sent to the first memory 311 to set the situation when the power supply was turned off (step S226). On the other hand, if the backup data are decided not to exist in the second memory 312 (NO at step S225), default image forming conditions such as copy number of one, automatic density setting, automatic paper selection and magnification power of one are set (step S226). After the above-mentioned processing, other key-inputs are processed (step S224). Then, the flow returns to the main flow.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. An image forming apparatus comprising:

a first switching device which switches the image forming apparatus from a first state to a second state;

a second switching device which switches the image forming apparatus from the second state to the first state;

a start key which outputs a start signal;

an image forming device which forms an image in accordance with an image forming information when the start key outputs the start signal;

an inputting device which inputs an image forming information into the image forming device;

a memory which stores an image forming information inputted by the inputting device;

a resume device which supplies the image forming information stored in the memory to the image forming device when the second switching device switches the image forming apparatus from the second state to the first state;

a timer which counts a period after the first switching device switches the image forming apparatus from the first state to the second state; and a controller which inhibits the resume device to supply the image forming information to the image forming device when the timer counts up the period.

2. The image forming apparatus of claim 1, wherein the controller changes the period.

3. The image forming apparatus of claim 1, wherein an electric power is applied to the image forming apparatus by a power source during the first state, and an electric power is not applied to the image forming apparatus by the power source during the second state.

4. The image forming apparatus of claim 1, wherein the image forming information comprises at least one information selected from a group consisting of:

first information concerning a condition of the image forming device; and second information concerning an image which is to be formed by the image forming device.

5. The image forming apparatus of claim 1 wherein the controller which inhibits the resume device by exchanging the image forming information stored in the memory for a default image forming information.

6. An image forming apparatus comprising:

a first switching device which switches the image forming apparatus from a first state to a second state;

a second switching device which switches the image forming apparatus from the second state to the first state;

a start key which outputs a start signal;

an image forming device which forms an image in accordance with an image forming information when the start key outputs the start signal;

an inputting device which inputs an image forming information into the image forming device;

a memory which stores an image forming information which is inputted by the inputting device;

a resume device which supplies the image forming information stored in the memory to the image forming device when the second switching device switches the image forming apparatus from the second state to the first state;

an interrupting device which enters an image forming information into the image forming device; and a controller which allows the image forming information entered by the interrupting device to be supplied to the image forming apparatus regardless of the image forming information stored in the resume device when the image forming apparatus is in a predetermined state.

7. The image forming apparatus of claim 6, wherein an electric power is applied to the image forming apparatus by a power source during the first state, and an electric power is not applied to the image forming apparatus by the power source during the second state.

8. The image forming apparatus of claim 6, wherein the image forming information comprises at least one information selected from a group consisting of:

first information concerning a condition of image forming device; and second information concerning an image which is to be formed by the image forming device.

9. An image forming apparatus comprising:

a memory which stores image forming information;

an image forming device which forms an image in accordance with the image forming information stored in the memory;

a timer; and a controller which inhibits the image forming apparatus from forming an image in accordance with the image forming information stored in the memory after the timer counts to a predetermined period.

10. The image forming apparatus of claim 9 further comprising:

a first switching device which switches the image forming apparatus from a first state to a second state; and a second switching device which switches the image forming apparatus from the second state to the first state;

wherein the timer counts the period after the first switching device switches the image forming apparatus from the first state to the second state.

11. The image forming apparatus according to claim 9, wherein the image forming information is one of control mode, copy number and paper size.

12. An image forming apparatus comprising:

an image forming device which forms an image in accordance with an image forming information;

an automatic shut-off for automatically shutting off the image forming device under predetermined conditions;

an inputting device which inputs an image forming information into the image forming device;

an interrupting device for inputting alternative image forming information into the image forming device when the image forming device is turned on after an automatic shut-off; and a controller which allows the alternative image forming information entered by the interrupting device to be supplied to the image forming apparatus regardless of the image forming information inputted by the inputting device when the image forming apparatus is in a predetermined state.

13. An image forming apparatus comprising:

a first switching device which manually switches the image forming apparatus from a first state to a second state;

a second switching device which automatically switches the image forming apparatus from the first state to the second state;

a memory which stores an image forming information;

an image forming device which forms an image in accordance with the image forming information stored in the memory;

a first controller which delete the image forming information stored in the memory when the first switching device switches the image forming apparatus from the first state to the second state; and a second controller which maintains the image forming information stored in the memory when the second switching device switches the image forming apparatus from the first state to the second state.

14. The image forming apparatus of claim 13 further comprising a resume device which supplies the image forming information stored in the memory to the image forming device.

15. The image forming apparatus of claim 13, wherein the second switching device detects a state of the image forming apparatus, and the image forming apparatus is switched automatically from the first state to the second state in response to the state detected by the second switching device.

16. The image forming apparatus of claim 13 wherein the state detected by the second switching device is a period when the image forming device does not form the image.

17. The image forming apparatus of claim 13, wherein an electric power is applied to the image forming apparatus by a power source during the first state, and an electric power is not applied to the image forming apparatus by the power source during the second state.

18. The image forming apparatus of claim 13, wherein the image forming information comprises at least one information selected from a group consisting of:

first information concerning a condition of image forming device; and second information concerning an image which is to be formed by the image forming device.

19. An image forming apparatus comprising:

a first switching device which switches the image forming apparatus from a first state to a second state;

a second switching device which switches the image forming apparatus from the second state to the first state;

a memory which stores an image forming information;

an image forming device which forms an image in accordance with the image forming information stored in the memory; and a controller which delete the image forming information stored in the memory when the first switching device switches the image forming apparatus from the first state to the second state.

20. The image forming apparatus of claim 19, wherein an electric power is applied to the image forming apparatus by a power source during the first state, and an electric power is not applied to the image forming apparatus by the power source during the second state.

21. The image forming apparatus of claim 19, wherein the image forming information comprises at least one information selected from a group consisting of:

first information concerning a condition of image forming device; and second information concerning an image which is to be formed by the image forming device.

* * * * *